United States Patent [19]

Karge

[11] Patent Number: 4,580,955

[45] Date of Patent: Apr. 8, 1986

[54] ECCENTRIC SCREW PUMP FOR THE CONVEYING OF LIQUIDS FROM BORE HOLES

[75] Inventor: Volkmar Karge, Obernkirchen, Fed. Rep. of Germany

[73] Assignee: Joh. Heinrich Bornemann GmbH & Co. KG, Obernkirchen, Fed. Rep. of Germany

[21] Appl. No.: 679,694

[22] Filed: Dec. 10, 1984

[30] Foreign Application Priority Data

Dec. 14, 1983 [DE] Fed. Rep. of Germany ..... 3345233

[51] Int. Cl.[4] ..... F04C 2/107; F04C 5/00; F04C 11/00

[52] U.S. Cl. ..... 418/5; 418/48; 418/69

[58] Field of Search ..... 418/5, 48, 69, 220; 464/163

[56] References Cited

U.S. PATENT DOCUMENTS

| | | | |
|---|---|---|---|
| 2,927,774 | 3/1960 | Ormsby | 464/163 |
| 3,982,858 | 9/1976 | Tschirky | 418/48 |
| 4,311,443 | 1/1982 | Clark et al. | 418/48 |

FOREIGN PATENT DOCUMENTS

| | | | |
|---|---|---|---|
| 1928318 | 6/1970 | Fed. Rep. of Germany . | |
| 1553156 | 11/1970 | Fed. Rep. of Germany . | |
| 436843 | 10/1935 | United Kingdom | 418/48 |
| 679163 | 9/1952 | United Kingdom . | |
| 972796 | 10/1964 | United Kingdom . | |
| 1119752 | 7/1968 | United Kingdom . | |
| 1564833 | 4/1980 | United Kingdom . | |
| 2084697 | 4/1982 | United Kingdom | 418/48 |
| 2124305 | 2/1984 | United Kingdom . | |

*Primary Examiner*—John J. Vrablik

*Attorney, Agent, or Firm*—Schwartz, Jeffery, Schwaab, Mack, Blumenthal & Evans

[57] ABSTRACT

Disclosed is an eccentric screw pump for conveying liquids from bore holes, in particular oil well bores. The pump includes an eccentric screw, a stator associated with the screw and located at the lowest point of a riser, and an aboveground drive and bearing unit, the drive shaft of which is connected with a rod linkage by means of a rotating joint which transmits torque and axial force. The rotor is suspended from the rod linkage. For the installation of several conveying units in series and/or of reserve units, several separate stators vertically aligned with each other may be built into the riser and/or several rotors may be placed above each other in the linkage.

10 Claims, 6 Drawing Figures

ECCENTRIC SCREW PUMP FOR THE CONVEYING OF LIQUIDS FROM BORE HOLES

BACKGROUND OF THE INVENTION

The present invention relates to an eccentric screw pump for conveying liquids from bore holes, especially oil well bores. The pump includes an eccentric screw, a stator associated with said screw and located at the deepest point of a riser, and an aboveground drive and bearing unit, the drive shaft whereof is connected with a rod linkage by means of a rotating joint which transmits torque and axial force, with the rotor being suspended from said rod linkage. The eccentric screw shall be referred to hereafter as the rotor.

In known eccentric screw pumps of this type the necessary discharge pressure is produced by a single conveying unit consisting of a stator with a rotor located therein. The stator may be composed of several individual stators. The conveying unit is arranged at the deepest point of the riser, with filters and a suction pipe being provided optionally below the stator. The rod linkage carrying the rotor is fastened by means of a coaxial screw joint to the drive shaft of the aboveground drive and bearing unit, said drive shaft being of massive constructon. The rotor is positioned within the stator by means of rod shaped adaptors mounted on the upper end of the linkage.

When the rotor becomes worn, the linkage, which may be several hundred meters long, must be disassembled, while in the case of a worn stator both the riser and the linkage must be removed. It is a further disadvantage that, because of the aforementioned adaptors in the rod linkage, the positioning of the rotor with respect to the stator associated with it is possible in discrete steps only.

SUMMARY OF THE INVENTION

It is an object of the present invention to provide an improved screw pump of the above-described type.

It is especially an object of the invention to provide a screw pump having improved performance and manipulation.

These objects are attained according to the invention by a riser in which a plurality of separate stators are aligned vertically with each other and/or in the rod linkage several rotors are arranged above each other.

It will be necessary in most embodiments during insertion or withdrawal to place the largest cross section of the rod linkage and also the joints of the linkage on the two rotor ends within the inner circular cross section of the stator, in a projection perpendicular to the linkage. Thus, the greatest diameter of the rod linkage and joints must be less than the least inner diameter of the stator. In this manner, the linkage may always be pushed through a stator. This is particularly necessary if the discharge pressure required is no longer to be produced by a single conveying unit but by several such units, which are located either in relatively short intervals at the deepest point of the riser, or in a more or less uniform distribution over the entire length of the riser, as pressure booster stations in the form of a series layout.

It is further advantageous to provide the rotating joint between the drive shaft and the rod linkage in the form of a clutch, making possible a rotational connection at any height of the upper end of the linkage with respect to the drive shaft. This permits a continuous adjustment of the rotor in height and, thus with great accuracy in relation to the stator associated with it.

In a preferred embodiment, the drive shaft may be in the form of a hollow shaft penetrated by the upper end of the rod linkage, with a seal being provided between the hollow shaft and the end of the linkage. The torque and the axial force are transmitted from the hollow drive shaft to the upper, cylindrical end of the linkage advantageously by a frictional joint, so that the upper end of the linkage may be held in any desired position without damage. A separate clamping element may be provided for this purpose; it has a positive connection to the hollow shaft, for example, in the form of a key, an end key or a type of claw clutch, but it has a frictional joint at the upper end of the linkage.

It is further advantageous to provide at least one reserve stator, not having a rotor being associated with it, and/or at least one reserve rotor not having a stator associated therewith. Thus, for example, one reserve stator may be arranged between two conveying units, each of which consists of a stator and a rotor and a second one below or above the two conveying units. By raising or lowering the rod linkage, the rotors located above or below the reserve stators can be caused to engage the reserve stators, whereby the stator/rotor pairs previously engaged are separated. For this purpose, sufficiently long cylindrical end pieces must be chosen for the upper end of the linkage in order to make the necessary lowering or raising of the linkage possible. This layout eliminates the need for the complete removal of the entire riser and/or the complete rod linkage, in case of the wearing out of a stator or a rotor. In the same way reserve rotors can be used.

Both the reserve stator and the reserve rotor may have standard dimensions. It is possible, however, to design the reserve stator with wear compensating reduced dimensions and the reserve rotor with excess dimensions for wear compensation.

Finally, it is advantageous to assemble the linkage from API shafts screwed into the frontal ends of the rotors. These shafts are standardized by the American Petroleum Institute and are equipped at their ends with standardized external threads. Different joints are also possible.

The upper end of the linkage consists, preferably, of at least one standardized polished rod which is known in linkages of this type and which has a calibrated cylindrical surface, against which the seal is applied with regard to the hollow shaft. These standardized polished rods are provided at their ends with external threads of a smaller diameter, so that the upper end of the linkage may be suspended in a simple manner from a lifting device.

Further objects, features and advantages will become apparent from the detailed description of preferred embodiments which follows, when considered with the attached figures of drawing.

DETAILED DESCRIPTION OF PREFERRED EMBODIMENTS

FIGS. 1 to 4 show the lower end of an oil well bore hole 1, into which an eccentric screw pump is inserted, said pump comprising a riser 2 and a rod linkage 3 arranged in the riser 2.

Figure 1:
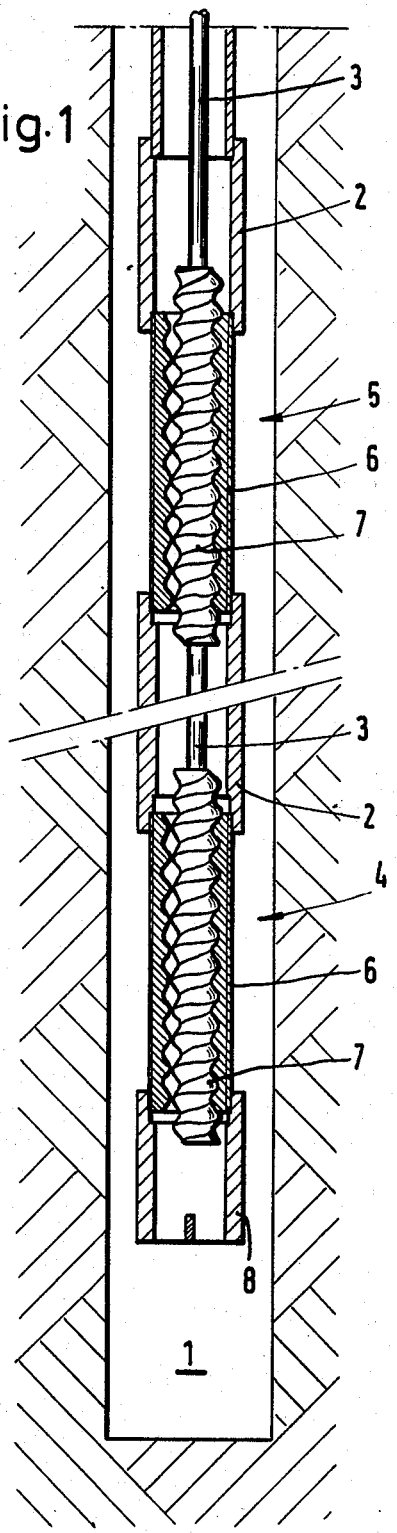
FIG. 1 is a sectional view of an eccentric screw pump with two conveying units arranged above each other.

According to FIG. 1, two conveying units 4, 5 are provided, each of which comprises a stator 6 and an eccentric screw 7, to be referred to generally as the rotor hereafter. The two stators 6 are aligned vertically with respect to each other and are spaced apart in the riser 2. The two rotors 7 are suspended from the linkage 3, which, for example, may consist of API shafts screwed into the front ends of the rotors 7. A suction pipe 8 follows the lower end of the bottom stator 6, wherein a filter, not shown, may be arranged.

Figure 2:
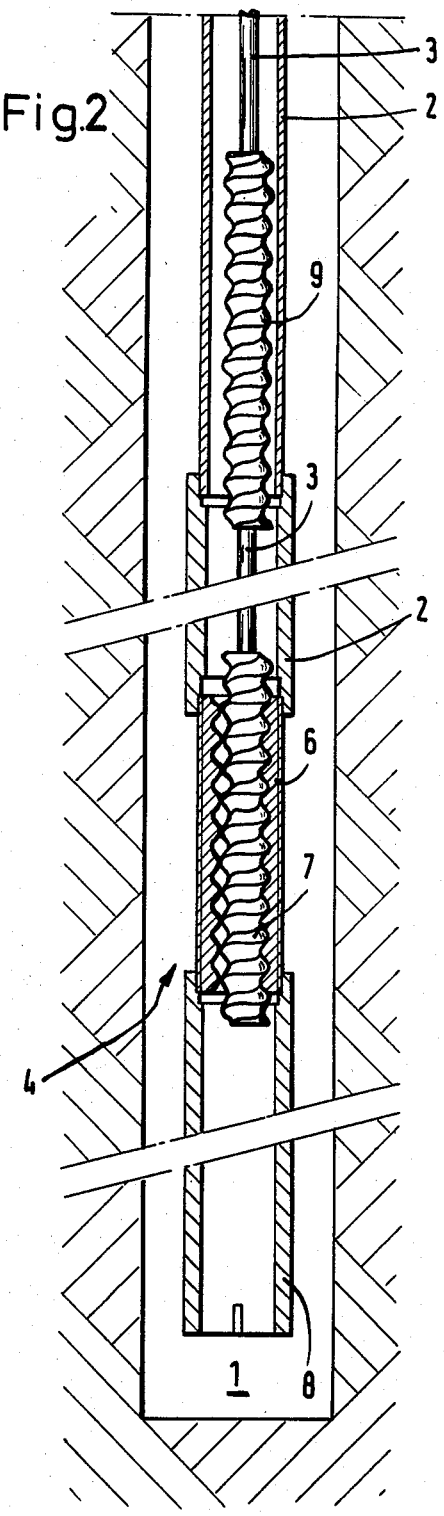
FIG. 2 is a sectional view of an eccentric screw pump with a single conveying unit and a reserve rotor located above it.

In the embodiment of FIG. 2, only one conveying unit 4 is provided; it is preceded on top by a reserve rotor 9. By lowering the linkage 3, the rotor 7, associated with the stator 6, is disengaged from the stator, while the reserve rotor 9 is inserted into the stator 6. In this case the suction pipe 8 is long enough to receive the rotor 7, thereby preventing the impact of the rotor 7 onto the bottom of the well bore 1. Reserve rotor 9 may be dimensioned to compensate for the increased internal dimensions of stator 6 due to wear. In other words, the reserve rotor is provided with wear-compensating excess dimensions.

In the embodiment of FIG. 3, again only one conveying unit 4 is provided, which in this case is followed by a reserve stator 10. If the stator 6 of the conveying unit 4 is worn out, the linkage 3 with the rotor 7 is lowered until the latter has been completely inserted into the reserve stator 10. Again, reserve stator 10 may be provided with smaller internal dimensions to mesh better with a rotor 7 which has presumably been at least partially worn down. In other words, reserve stator 10 may comprise wear-compensating reduced dimensions.

Figure 3:
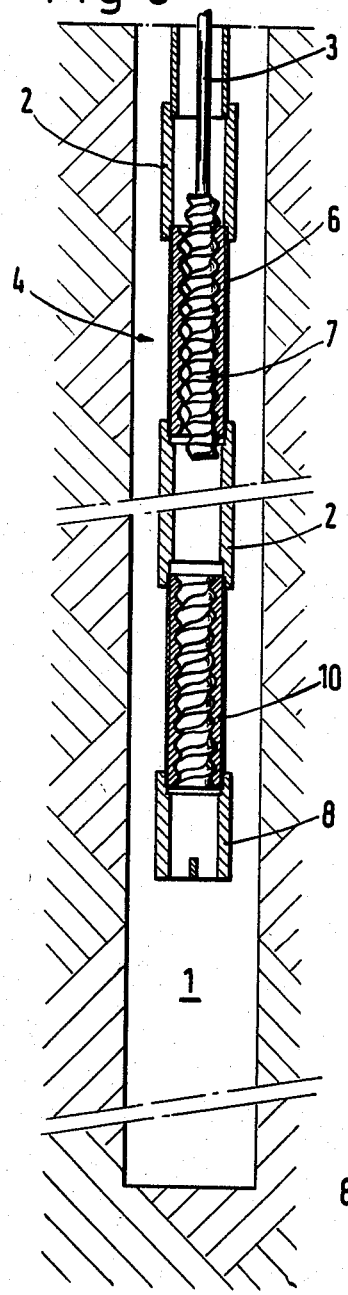
FIG. 3 is a sectional view of an eccentric screw pump and a reserve stator located under it.
Figure 4:
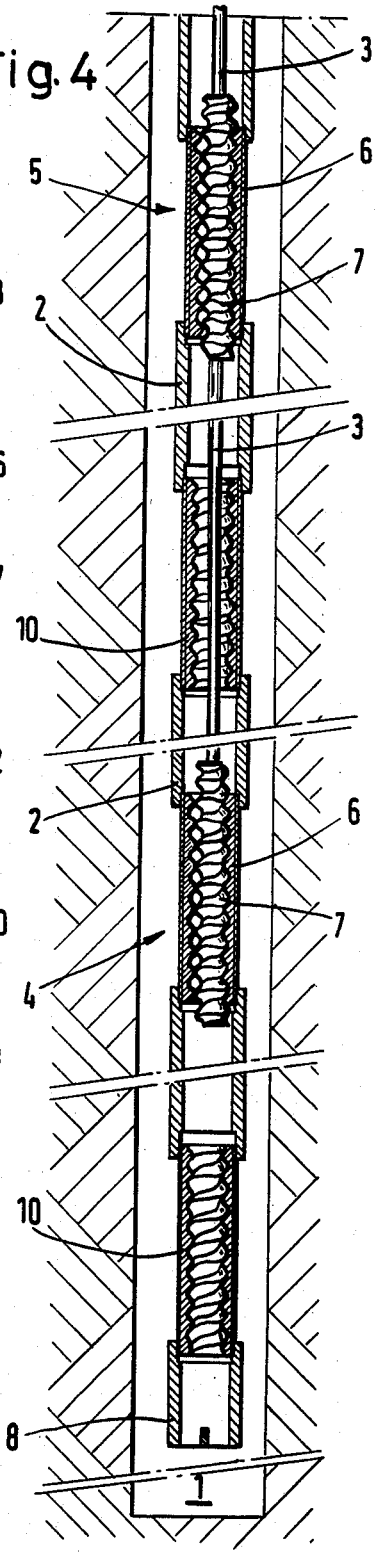
FIG. 4 is a sectional view of an eccentric screw pump in a view accoridng to FIG. 3, with two conveying units arranged above each other, with a reserve stator provided below each of them.

The embodiment of FIG. 4 represents a combination of the embodiments of FIGS. 1 and 3. Here again, two conveying units 4, 5 are provided, each of which is followed below by a reserve stator 10. Obviously, over the length of the well bore 1 further conveying units could be arranged, between each of which a reserve stator 10 may be located. In place of the reserve stators 10, each of the conveying units could be preceded by a reserve rotor 9, as seen in FIG. 2.

Figure 5:
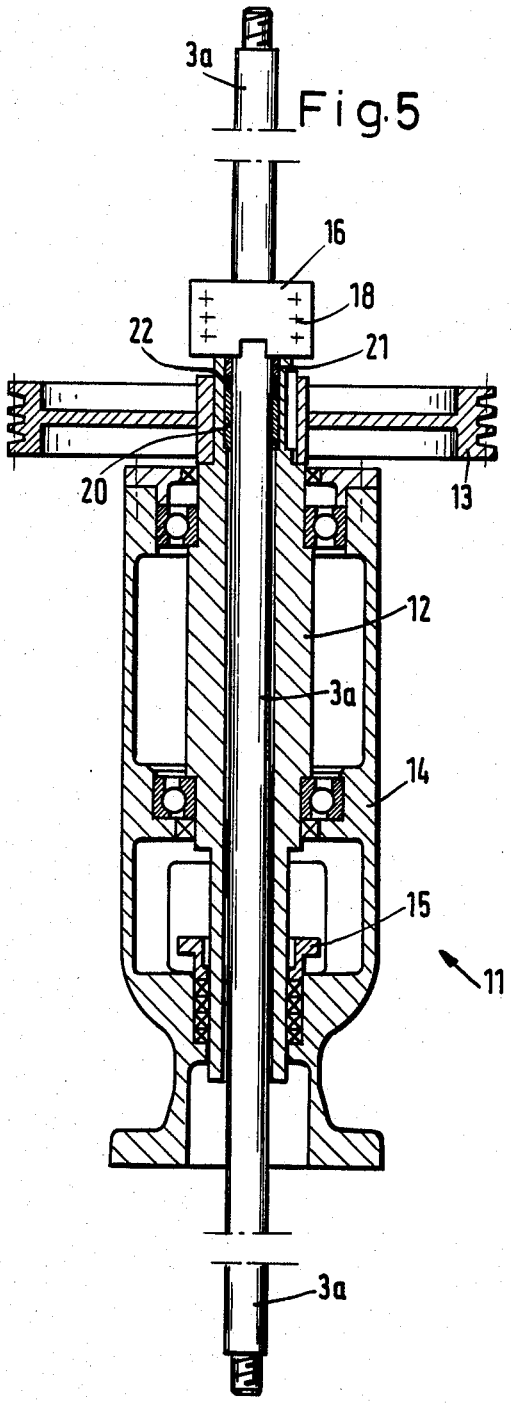
FIG. 5 is a front sectional view of an aboveground drive and bearing unit.

FIG. 5 shows an aboveground drive and bearing unit 11 for the linkage 3. A drive shaft 12 is provided in the form of a hollow shaft, which in turn is driven by a motor, not shown, by means of a V belt pulley 13 fixed for rotation with said drive shaft. The drive saft 12 is supported by bearings in a housing 14. The seal between the housing 14 and the external periphery of the drive shaft 12 is provided by a seal 15.

The upper end 3*a* of the rod linkage 3, which may consist, e.g., of a standardized polished rod with a circumference in the form of a cylindrical adaptor, protrudes through the hollow rod 12 and is connected therewith by means of a clutch which permits a rotating joint in any height position of the upper rod end 3*a* with respect to the drive shaft 12. This clutch consists on the one hand of two clamp halves 16, 17 pressed by means of six clamp bolts 18 positively against the upper end 3*a* of the linkage 3, and two frontal keys 19 provided at the upper end of the hollow shaft 12, which in the manner of a claw clutch enter corresponding recesses in the lower edge of the clamp halves 16, 17, thereby effecting a positive joint for rotation. The torque and the axial force is thus transmitted from the hollow drive shaft 12 to the upper end 3*a* of the linkage 3 by a frictional connection, so that the upper end 3*a* of the linkage may be held in any position without being damaged.

Two bushings 20 and 21, with an O-ring 22 placed between them, are provided as a seal between the upper end 3*a* of the linkage and the hollow shaft 12. This seal is located, preferably, directly in the upper end of the hollow shaft 12.

Figure 6:
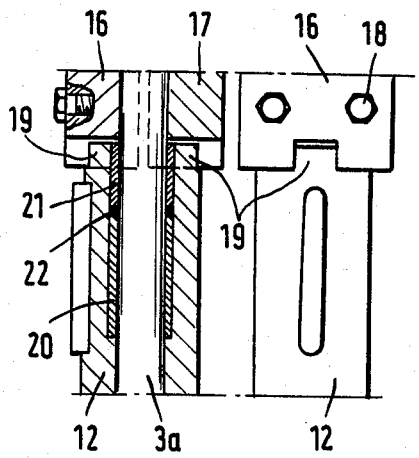
FIG. 6 is a detailed view of a portion of FIG. 5, at an enlarged scale, wherein the left view is rotated by 90° with respect to that of FIG. 5, while the right hand view shows the layout according to FIG. 5, but in a side elevation.

FIG. 6 shows, slightly enlarged with respect to FIG. 5, the upper end of the hollow shaft 12 with the clamp halves 16, 17, wherein the left-side view in FIG. 6 is a longitudinal section rotated to the left by 90° with respect to the view in FIG. 5, while the right-side view of FIG. 6 shows the layout according to FIG. 5 in a lateral elevation. This figure shows only two clamping bolts 18, for purpose of clarity.

What is claimed is:

1. An eccentric screw pump for conveying liquids from a bore hole, comprising:
   - a riser located in the bore hole;
   - a stator located near the bottom of said riser;
   - a rotor comprising an eccentric screw and being associated with said stator;
   - a rod linkage connected to said rotor;
   - an aboveground drive and bearing unit having a drive shaft connected with said rod linkage by means of a rotating joint which transmits torque and axial force; and
   - reserve means located in said bore hole for replacing one of said stator and said rotor upon a relative vertical displacement of said stator and said rotor, said reserve means being vertically displaceable between an inoperative position in which said reserve means are not associated with a rotor and are not associated with a stator and an operative position in which said reserve means replaces one of said rotor and said stator.

2. An eccentric screw pump according to claim 1, wherein the diameter of the rod linkage and the linkage joints at both ends of the rotor are dimensioned to be locatable within the internal diameter of the stator.

3. An eccentric screw pump according to claim 1, wherein said rotating joint between the drive shaft and the rod linkage comprises a clutch means for permitting the establishment of a rotating joint in any height position of the upper end of the rod linkage in relation to said drive shaft.

4. An eccentric screw pump according to claim 3, wherein the drive shaft comprises a hollow shaft through which the upper end of the rod linkage protrudes, and further comprising a seal provided between the hollow shaft and the end of the rod linkage.

5. An eccentric screw pump according to claim 1, wherein said reserve means comprises at least one reserve stator, which has no rotor associated with it.

6. An eccentric screw pump according to claim 1, wherein said reserve means comprises at least one reserve rotor which has no stator associated with it.

7. A an eccentric screw pump according to claim 5, wherein the reserve stator comprises wear-compensating reduced dimensions.

8. An eccentric screw pump according to claim 6, wherein the reserve rotor comprises wear-compensating excess dimensions.

9. An eccentric screw pump according to claim 1, wherein the rod linkage comprises shafts screwed into the front ends of each rotor.

10. An eccentric screw pump according to claim 1, wherein the upper end of the rod linkage comprises a standard polished rod.

* * * * *